United States Patent [19]

Wertheimer

[11] 4,022,237

[45] May 10, 1977

[54] EXHAUST GAS RECIRCULATION FLOW CONTROL SYSTEM

[75] Inventor: Harry P. Wertheimer, Horseheads, N.Y.

[73] Assignee: The Bendix Corporation, South Bend, Ind.

[22] Filed: July 29, 1975

[21] Appl. No.: 600,172

Related U.S. Application Data

[62] Division of Ser. No. 446,856, Feb. 28, 1974, Pat. No. 3,926,161.

[52] U.S. Cl. ..... 137/85; 137/102

[51] Int. Cl.[2] ..... F15B 5/00

[58] Field of Search ..... 123/119 A; 137/85, 102

[56] References Cited

UNITED STATES PATENTS

| | | | |
|---|---|---|---|
| 3,461,896 | 8/1969 | Holloway | 137/85 |
| 3,575,190 | 4/1971 | Duster et al. | 137/85 |
| 3,661,164 | 5/1972 | Kreuter | 137/85 |
| 3,739,797 | 6/1973 | Caldwell | 123/119 A |
| 3,814,070 | 6/1974 | Wertheimer | 123/119 A |
| 3,861,642 | 1/1975 | Maddocks | 123/119 A |
| 3,926,161 | 12/1975 | Wertheimer | 123/119 A |

*Primary Examiner*—C. J. Husar
*Assistant Examiner*—David D. Reynolds
*Attorney, Agent, or Firm*—Ken C. Decker; William N. Antonis

[57] ABSTRACT

The present invention relates in general to reducing the internal combustion engine exhaust emission polutants. More specifically, it relates to a control device that regulates the amount of exhaust gas being recirculated into the intake manifold of an internal combustion engine such that the exhaust gas recirculation flow is nearly proportional to engine air flow, and is a controlled function of intake manifold vacuum. The flow may be completely inhibited at low engine temperatures and also at times of low manifold vacuum and high engine air flow in order to maintain acceptable driveability.

10 Claims, 6 Drawing Figures

FIG. 2
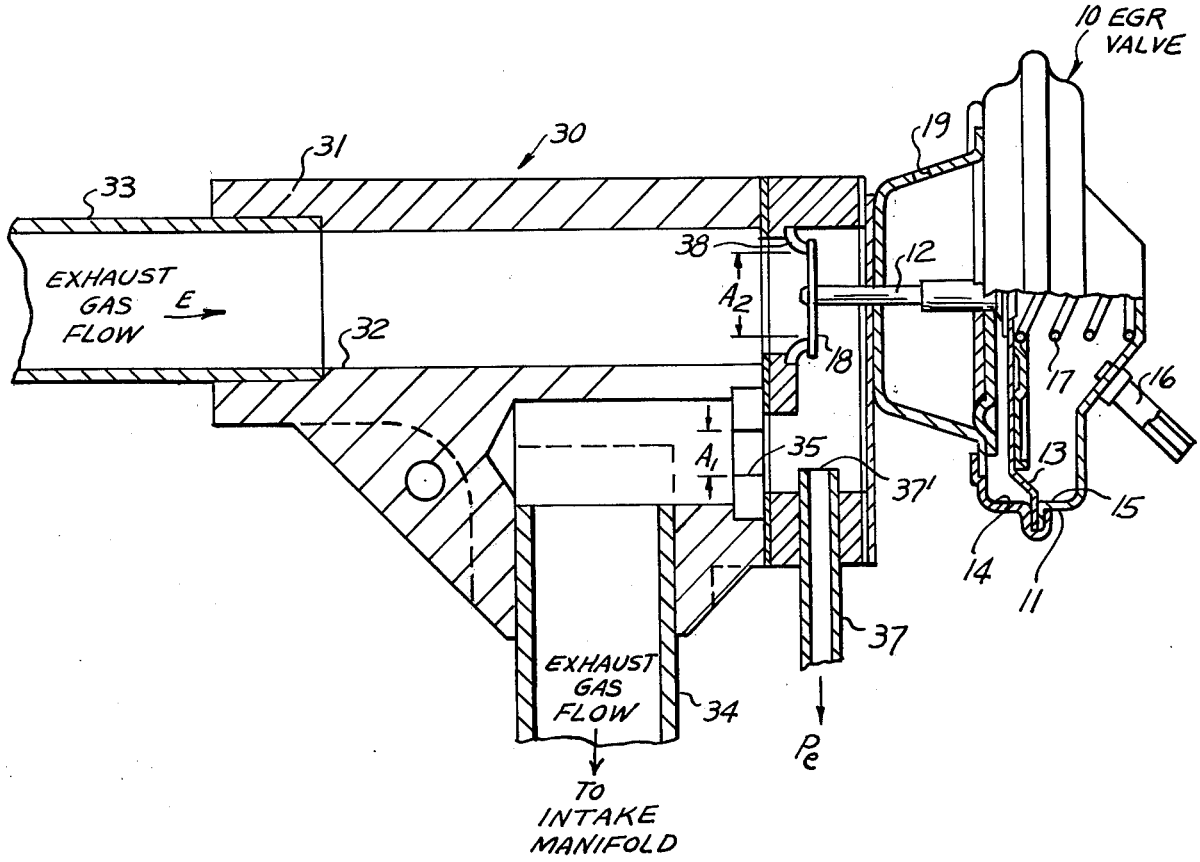
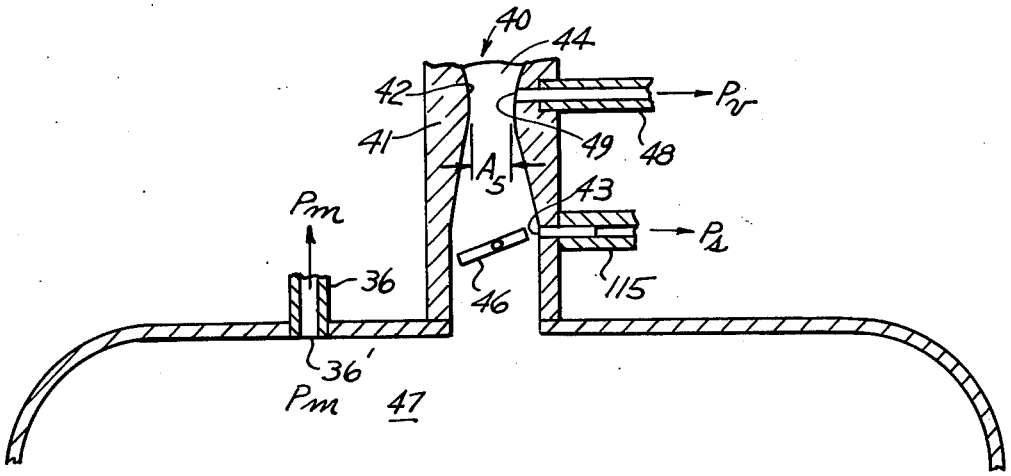
FIG. 3

EGR VALVE FLOW VS. CARB AIR FLOW

EXHAUST GAS RECIRCULATION FLOW CONTROL SYSTEM

This is a division, of application Ser. No. 446,856, filed Feb. 28, 1974, now U.S. Pat. No. 3,926,161.

CROSS REFERENCES TO RELATED APPLICATIONS

The present invention is an improvement over the exhaust gas recirculation control system described in co-pending, commonly assigned U.S. patent application Ser. No. 318,150, entitled "Exhaust Gas Recirculation Flow Control System" filed Dec. 26, 1972.

BACKGROUND OF THE INVENTION

A major source of atmospheric air pollution is the exhaust gas from automobile engines. A present approach to control this general problem is to modify engine operation parameters through spark timing contols systems to alter combustion in conjunction with the addition of an exhaust gas treating device to minimize the output of undesirable exhaust gas pollutants.

To reduce emission of oxides of nitrogen, one of several gaseous emissions considered harmful, several controlled approaches which operate to lower peak combustion temperatures have been used. Of these approaches, one in which a portion of the engine exhaust is recirculated into the combustion chamber along with the fuel charge, has been found effective and has gained favor with those versed in the art.

Exhaust gas recirculation (EGR) is the process by which a portion of the exhaust gases are recirculated to the intake manifold primarily for the purpose of reducing the oxides of nitrogen to a level which is acceptable per federal and some state exhaust emissions standards. Prior art EGR has been implemented using controls ranging in sophistication from a simple on-off control to a closed loop control system which achieves optimum control of exhaust gas recirculation for maximum effectiveness at minimum loss in vehicle driveability. With the simple on-off control, the amount of exhaust gas recirculated increases with increasing intake manifold vacuum and is not correlative to air flow into the engine. This type of system is not necessarily the most desirable, in that, exhaust gas recirculation rates, which increase with intake manifold vacuum will not permit a good compromise between driveability and economy on one hand and oxides of nitrogen on the other. This would necessitate a need for larger engines and higher fuel consumption to get the same performance characteristics as was obtainable before utilizing EGR to control pollutants. Therefore, it was determined that for maximum effectiveness of pollutant control, consistent with acceptable vehicle driveability and economy requirements, the EGR flow should be maintained as a relative constant percentage of the engine's air flow, and further, EGR should be inhibited at low ambient or engine temperatures as well as at low and high engine air flows. These parameters are consistent with driveability, economy and emissions requirements normally associated with high speed operation of the vehicle and with urban driving.

Devices such as the venturi vacuum amplifier, which attempt to maintain a degree of proportionality between the amount of EGR and total engine air flow, are limited in attaining the above objectives in that these devices are sensitive to engine air flow, but there is no feedback from the exhaust gas recirculation portion of the EGR system thereby enabling automatic adjustment to be made to the system to compensate for variations between EGR valves. Further, the basic venturi vacuum amplifier system as well as some feedback type systems allow the EGR as a fraction of air flow to increase or at best stay constant as manifold vacuum increases.

The closed loop exhaust gas recirculation control system described in co-pending, commonly assigned U.S. patent application Ser. No. 318,150 achieves optimum control of exhaust gas recirculation for maximum effectiveness of pollutant control and minimum loss in vehicle driveability and economy requirements. This type of EGR control provides a feedback from the exhaust gas recirculation flow as well as sensing engine air flow, thereby enabling continuous adjustments to be made within the system to compensate for changes in the sensed engine varibles. In this type of closed loop prior art system, an engine air flow responsive means operative to provide a differential pressure related to engine air flow, and a recirculated exhaust gas flow responsive means operative to provide a differential pressure related to recirculated exhaust gas flow, is communicated to a control valve assembly which through a plurality of diaphragms present therein sums these differential pressures in order to regulate an exhaust gas recirculation valve on a proportional basis. The control valve is biased so as to inhibit EGR flow at low, engine air flow, and additional provisions for inhibiting EGR flow at high engine air flow as well as a temperature responsive member to inhibit EGR flow at a predetermined low ambient temperature is included in the closed loop system.

In this type of closed loop system it was initially believed that the exhaust gas flow responsive means should be located in the exhaust gas passage directly ahead (upstream) of the EGR valve, with the independent function of metering the amount of exhaust gas being performed by a limiting orifice located in the exhaust gas passage downstream of the EGR valve. Therefore, the prior art disclosure performs the flow sensing function by sensing the pressure drop across a venturi located upstream of the EGR valve in the recirculation exhaust gas passage. This provides a differential pressure which is a function of exhaust gas flow.

Placing the flow sensing element downstream of the EGR valve was an approach considered less desirable since the intake manifold vacuum would need to be used as a reference point to provide the differential pressure necessary to sense exhaust gas flow. Initial considerations of using intake manifold vacuum to sense exhaust gas flow was negated by the fact that pressure fluxuations in the intake manifold are much greater than the pressure fluxuations in the exhaust manifold. Therefore, placing the flow sensing element downstream of the EGR valve was an approach considered less desirable since the extreme intake manifold vacuum fluxuations appeared difficult to handle. Following this analysis, the idea of utilizing intake manifold vacuum as a control function was not pursued.

The problem associated with sensing exhaust gas flow in the exhaust gas passage between the EGR valve and the exhaust manifold were caused by pressure pulsations arising from the cyclic nature of the internal combustion engine. Initially dampening devices were used to attempt to dampen out the pulsations and thereby create some degree of stability in the control system. However, dampening the exhaust pulsations caused limitations in responses of the recirculated exhaust gas flow signal. This limitation of response resulted in poor transient behavior of the control system in practice.

BRIEF SUMMARY OF THE INVENTION

The invention is a closed loop exhaust gas recirculation flow control system which provides a means to regulate and control the amount of exhaust gas recirculated to the intake manifold as a function of engine air flow and intake manifold vacuum. The exhaust gas recirculation flow control system disclosed herein is substantially insensitive to exhaust back pressure except when the flow becomes orifice limited. Also, the control system disclosed creates characteristic curves in which the percentage of exhaust gas recirculated is reduced at increased manifold vacuum. This characteristic is compatible with the need to maintain economy and driveability or engine performance while controlling emissions of oxides of nitrogen.

The invention is characterized by an engine air flow responsive means operative to provide a first signal corresponding to engine air flow, a means for generating a second signal in the intake manifold, and a receiving and regulating means which through a plurality of diaphragms sums these signals in order to regulate an exhaust gas recirculation valve on a continuous basis as a function of engine air flow and intake manifold vacuum. The invention is further characterized by an exhaust gas recirculation flow responsive means whereby the flow rate of exhaust gas recirculated is maintained at an established level for a given value of said first and second signal.

It is therefore the primary object of this invention to disclose a closed loop exhaust gas recirculation flow control system which achieves optimum control of exhaust gas recirculation for maximum effectiveness of pollution control and minimum loss in vehicle driveability.

It is a further object of the invention to provide an exhaust gas recirculation flow control system that controls the percentage of exhaust gases recirculated as a function of engine air flow and intake manifold vacuum.

It is a further object of this invention to provide an exhaust gas recirculation flow control system that enables a continuous control of the recirculation of the exhaust gases into the engine's intake manifold by means of a control valve assembly responsive to engine air flow, and intake manifold pressure, said control assembly utilizing a feedback loop in which recirculated exhaust flow is sensed.

Another object of this invention is to provide an exhaust gas recirculation flow control system wherein the amount of exhaust gas recirculated to the engine's intake manifold is inhibited at a predetermined low ambient temperature, inhibited at a low engine air flow, and/or also inhibited at a high engine air flow.

It is still a further object of the present invention to disclose an exhaust gas recirculation flow control system which is designed to be readily adjusted to compensate for tolerance variations of the various components within the control valve assembly. It is still a further object of this invention to disclose an exhaust gas recirculation flow control system that permits automatic compensation for tolerance variation of the EGR valve.

Yet another object of this invention is to provide an exhaust gas recirculation flow control system which may be utilized in combination with presently available exhaust gas recirculation valve and is economical to manufacture.

Other objects and advantages of the invention will become apparent from the description which follows, taken in conjunction with the accompanying drawings which show a preferred embodiment of the invention.

BRIEF DESCRIPTION OF THE FIGURES

FIG. 2 is a cross-sectional view of the preferred embodiment of the exhaust gas flow sensing means and its interrelationship with the standard EGR type valve.

FIG. 3 is a schematic view of a carburetor normally associated with an internal combustion engine and illustrating the engine air flow sensing means.

DETAILED DESCRIPTION OF THE DRAWINGS

Figure 1:
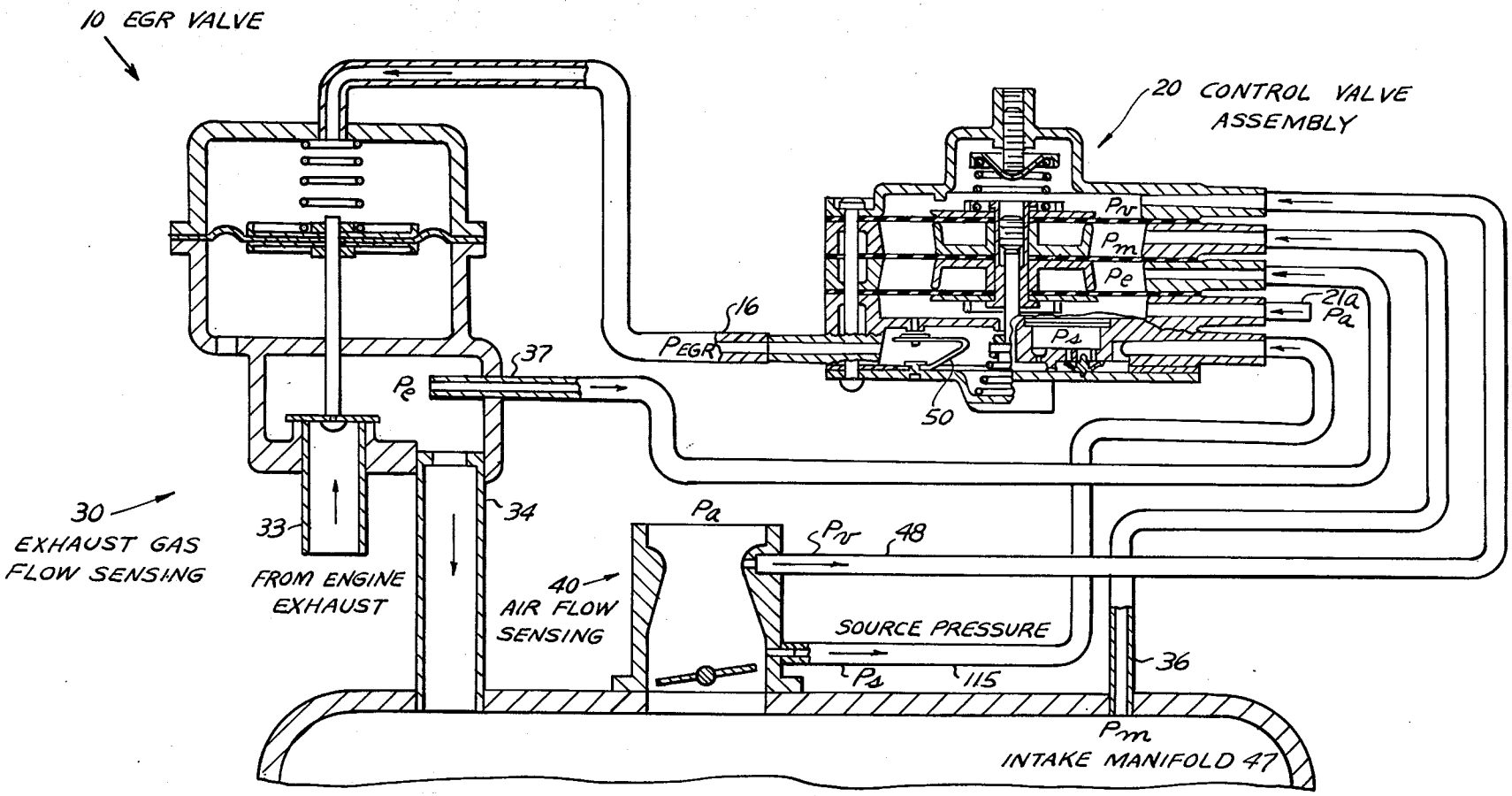
FIG. 1 is a diagramatic view of the exhaust gas recirculation flow control system.

The exhaust gas recirculation flow control system according to the invention is shown in FIG. 1. The control system is comprised of the engine air flow sensing means 40, the exhaust gas flow sensing means 30, and the control assembly 20 including the control valve member, and its related structure which controls the exhaust gas recirculation (EGR) valve 10. An example of the temperature responsive member 50 which may be used in combination with the inventive system is shown in FIG. 1.

Referring to FIG. 3, a carburetor 41 of the down draft type is shown having an air-fuel induction passage 45 with an atmospheric air inlet 44 at one end and connected to the engine's intake manifold 47 at the opposite end. Passage 45 contains a fixed area venturi 42 and a throttle valve 46. The latter is rotatably mounted on a part of the carburetor body across passage 45 in a manner to control the flow of air-fuel mixture into the intake manifold. Fuel is indicated from a nozzle, (not shown) projecting into or adjacent venturi 42.

Throttle valve 46 is shown in its engine idle speed position essentially closing induction passage 45 and is rotatable to a nearly vertical position essentially unblocking passage 45. A port or static tap 49 is provided in the throat of the venturi 42 which in combination with the venturi 42 and a conduit passage 48 mounted adjacent to static tap 49 comprises the engine air flow sensing means. The pressure or vacuum level at the static tap 49 is a function of the total air flow passing through venturi 42. That is, engine air flow is regulated by the relative position of throttle valve 46. As the throttle valve opens air flow increases which in turn causes the pressure at static tap 49 to decrease with respect to atmospheric pressure, or any pressure at an upstream stagnation point which is not shown. It has been shown that the stagnation point may also be between the static tap and the throttle plate in an area where the flow stream velocity is near zero. The vacuum or pressure which is created at static tap 49 for purposes of discussion will be labelled as $P_v$. Pressure signal $P_v$ is communicated to the control valve housing 21 shown in FIG. 1 through conduit member 48. The cross-sectional area of the throat of the venturi 42 is designated as $A_5$. The cross-sectional area $A_5$ is a design parameter which must be known since the disclosed system regulates EGR flow as a partial function of the air flow which passes through this venturi. A conduit passage 36 in the intake manifold 47 communicates the intake manifold pressure $P_m$ sensed at port 36' to the control valve housing 21.

A spark port 43 is provided at a point just above the idle position of throttle valve 46, which is traversed by the throttle valve 46 as it rotates to unblock passage 45. The vacuum or pressure level at spark port 43 will vary as a function of the rotational movement of the throttle valve, the spark port reflecting essentially atmospheric pressure upon closure of the throttle valve. The vacuum or pressure sensed at port 43 is communicated through conduit passage member 115 to the vacuum source 122 shown in FIG. 4. With this modification incorporated into the system, exhaust gas recirculation will be inhibited at small throttle openings, as well as at low engine air flow for reasons which will become more apparent from the following description.

Although the engine air flow sensing means 40 as herein described relates to a down draft type carburetor 41, element 40 can also be referred to more generally as any air throttling body since the disclosed system can be used in combination with any fuel metering system which senses air flow or in which an air flow sensor has been added.

Referring to FIG. 2, the exhaust flow responsive means 30 is shown. A housing 31 has a passage 32 formed therein to which is connected a pipe 33 from the exhaust manifold and a pipe 34 connected to the intake manifold. Disposed within the passage 32 and fixedly secured thereto is a valve seat 38 having a cross-sectional area $A_2$. A conduit passage 37 is located between the valve seat 38 and an orifice 35 disposed downstream of valve seat 38. The orifice 35 has a cross-sectional area $A_l$. Arrow E shows the direction of recirculated exhaust gas flow.

An EGR valve 10 which is of standard design is fixedly secured to the housing 31 by any conventional means such as bolting. The EGR valve is of the spring biased diaphragm type having a rod 12 fixedly secured to diaphragm 13. Diaphragm 13 divides the housing 11 of the EGR valve into two separate chambers 14 and 15, chamber 14 being exposed to ambient air through an opening 19 and chamber 15 communicating with control valve housing 21 (shown in FIG. 1) through conduit passage 16. Valve body 18 which is fixedly secured or integrally formed on rod 12 is biased against the valve seat 38 of housing 31 by spring 17 which has a predetermined spring force $F_l$. It is to be understood that as the pressure varies across the diaphragm 13 the rod and therefore the valve body 18 move towards or away from the valve seat 38 thereby controlling the amount of exhaust gas recirculated through passage 32 into the intake manifold 47.

Exhaust flow sensing is accomplished by measuring the pressure drop across restriction 35. Conduit passage member 37 which has an opening 37' senses the exhaust gas pressure $P_e$ in passage 32, between EGR valve 10 and restriction 35 and communicates this pressure to control valve housing 21. As discussed above, a conduit passage member 36 in the intake manifold 47 communicates the intake manifold pressure $P_m$ at opening 36' to the control valve assembly 21. The differential pressure established by pressures $P_e$ and $P_m$ increases with the flow rate of exhaust gas passing through orifice 35 in a manner like the differential pressure between atmospheric pressure $P_a$ and venturi pressure $P_v$ increases with the flow rate of air passing through carburetor venturi 42 as described above. Orifice 35 having a cross-sectional area $A_1$ serves the additional function of limiting the maximum amount of exhaust gas that can be recirculated to the intake manifold. By sensing exhaust gas flow downstream of EGR valve 10 the exhaust gas recirculated to the intake manifold can become a function of not only engine air flow, but also a function of intake manifold vacuum which will become apparent from the description which follows below.

Figure 4:
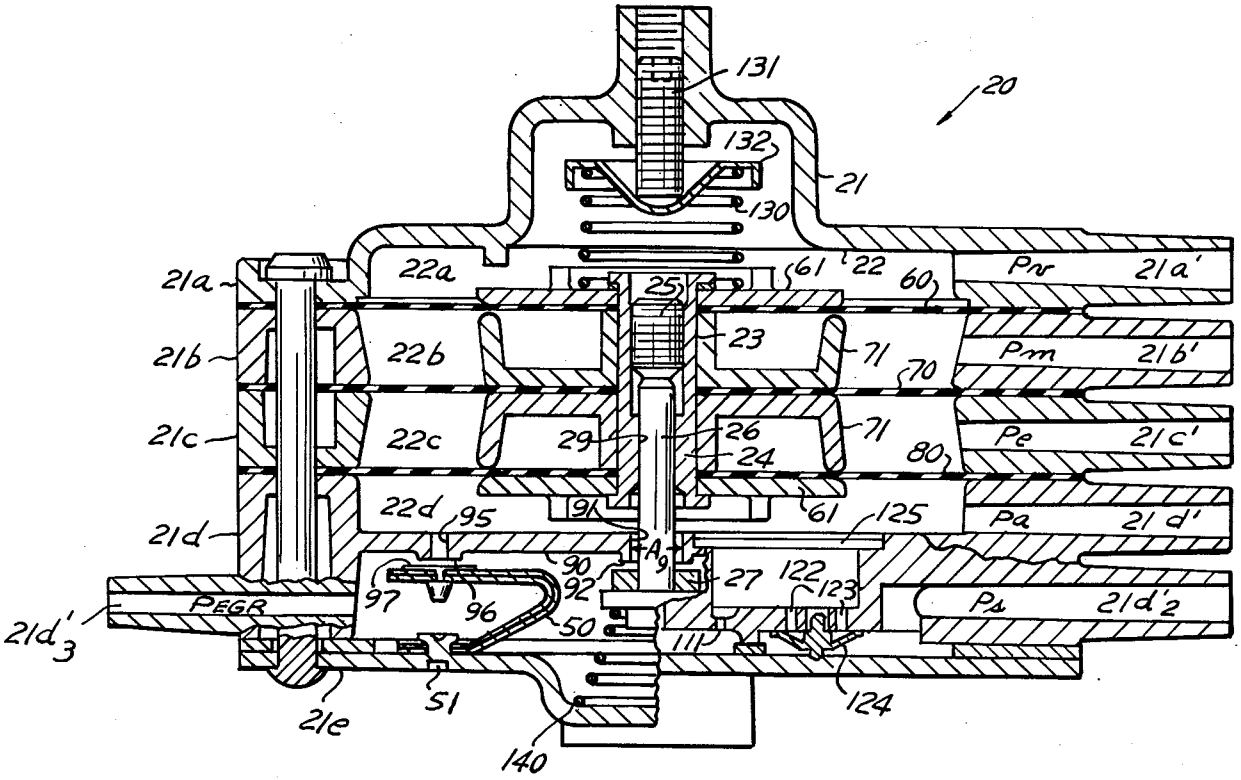
FIG. 4 is a cross-sectional view of the control valve assembly of the preferred embodiment of this invention.

Referring now to FIG. 4, the control valve assembly 20 of the exhaust gas recirculation flow control system is shown. The control valve housing 21 is of a laminated construction with sections 21*a* and 21*b* retaining a diaphragm 60 and sections 21*b* and 21*c* retaining a diaphragm 70 and sections 21*c* and 21*d* retaining a diaphragm 80 therebetween. These four sections form a cavity 22 which because of the diaphragms 60, 70 and 80 is divided into separate chambers 22*a*, 22*b*, 22*c* and 22*d*. These sections are secured to each other by any suitable means such as riveting, with cover section 21*e* completing the housing assembly. Disposed within cavity 22 and fixedly secured, through the use of distribution members 61 and 71, to the diaphragm 60, 70 and 80 is a control valve member 23. The portions of diaphragm 60, 70 and 80 which are included within the cavity 22 have effective cross-sectional areas $A_6$, $A_7$ and $A_8$ respectively. The "effective" area of a diaphragm is that area which is defined by the ratio of the resultant force to the applied pressure and therefore, the effective area is a function of both the outside diameter of the diaphragms within cavity 22 and the outside diameter of the pressure distribution members 61 nd 71.

Control valve member 23 is comprised essentially of three main parts, a stem portion 24, an adjustment member 25 and a piston member 26. Stem portion 24 is fixedly secured to diaphragms 60, 70 and 80 through distribution members 61 and 71. Adjustment member 25 is threadably disposed within stem portion 24. Stem portion 24 has a portion of its inner diameter 29 formed for receiving piston member 26. Piston 26 is slidably assembled into the formed portion 29 and the disposition of diaphragms 60, 70 and 80 as well as distribution members 61 and 71 within cavity 22 relative to piston member 26 is determined by adjustment member 25. The lower most extension of piston 26 has a valve 27 fixedly secured thereto. Valve 27 may be integrally formed with piston 26. Valve 27 is adapted to seat against valve seat 92 as the piston 26 translates within stem portion 24. The pressure signal $P_{EGR}$ which is communicated from cavity 90 to the EGR valve port 16 is a function of the relative position of valve 27 and may be of a magnitude equal to atmospheric $P_a$ or the source pressure $P_s$ in cavity 122 or some value in between.

Control valve member 23 is biased by spring members 130 and 140. Housing cover 21*e* is adapted to receive spring 140 so that the force generated by spring 140 can act in an axial direction upon piston 26. Similarly, housing chamber 21*a* is adapted to receive spring member 130 so that an adjustment screw 131 may be threadedly secured to housing cavity 21*a* and through spring retainer member 132 generate a force axially aligned with control valve member 23. Utilization of the biasing forces generated by spring member 130 and spring member 140 permits adjustment of the complete control valve assembly to compensate for tolerance variations between the subassembly of distribution members 61 and 71, stem 24 and diaphragms 60, 70 and 80. Any suitable means biasing the control valve member 23 with an adjustment feature can be utilized to accomplish a similar result.

Housing section 21*a* is adapted to receive pressure signal $P_v$ and by means of passage 21*a'* and conduit passage 48, chamber 22*a* communicates with static tap 49 in venturi throat 45. Hosuing section 21*b* is adapted to receive pressure signal $P_m$ from the intake manifold and through passage 21*b'* and conduit passage 36, chamber 22*b* communicates with the intake manifold 47. Housing section 21*c* is adapted to receive pressure signal $P_e$ and chamber 22*c* communicates, through passage 21*c'* and conduit passage 37, with the exhaust gas passage 32. Chamber cavity 22*d* is subject to a filtered source of atmospheric pressure $P_a$ communicated to cavity 22*d* through passage 21*d'* formed in housing section 21*d.* Chamber 22*d* is also connected through passage 91 to a second cavity 90 formed in housing section 21*d.* The lower portion of passage 91 forms the valve seat 92 projecting into cavity 90. Passage 91 has a cross-sectional area designated $A_9$. Housing cavity 90 communicates with chamber 15 of EGR valve 10 through EGR conduit passage 16 (see FIG. 2) and housing section 21*d* passage 21*d*$_3$'. Cavity 90 is formed by securing housing section cover 21*e* to section 21*d.*

Cavity 90 has a second passage 95 which communicates with housing chamber 22*d.* The lower portion of this passage terminates in a valve seat 96. A bimetallic strip 50 is mounted in cavity 90 secured to housing cover 21*e* by any conventional method such as riveting 51. The bimetallic strip 50 senses temperature in the vicinity of the control valve assembly 20 i.e., the engine compartment temperature, and in response to a predetermined temperature valve member 97 will seat upon valve seat 96 and terminate the communication of pressure signal $P_a$ from chamber 22*d* to cavity 90 through second passage 95. By terminating pressure signal $P_a$ through passage 95, the pressure in cavity 90 becomes a function of $P_s$ when valve 27 is closed. This function will be communicated to chamber 15 of EGR valve 10 and generate a force $F_2$ across diaphragm 13. when $F_2$ becomes greater than $F_1$ (spring force generated by spring 17) valve 18 will begin to open and exhaust gas will begin to flow through passage 32 into the intake manifold. This will be discussed in more detail in the operational discussion that follows. Other temperature responsive means can also be incorporated in this invention so that the control valve assembly 20 could also be made responsive to such temperature variables, as for example, the temperature of the engine coolant.

The combination of control valve cover 21*e*, housing section 21*d* and cover member 125, creates a third cavity 122 within housing section 21*d.* Cavity 122 communicates with cavity 90 through orifice 111. Housing section 21*d* is adapted to receive spark port signal $P_s$ sensed at port 43 of induction passage 45 and cavity 122 communicates with the carburetor's induction passage 45 through housing passage 21*d*$_2$' and conduit passage 115. A check valve 124 of standard design is disposed about the openings 123 of cavity 122 in order to insure an adequate power signal source regardless of variation in induction passage signal. An alternate source of power can be selected, namely, the intake manifold signal.

Figure 5:
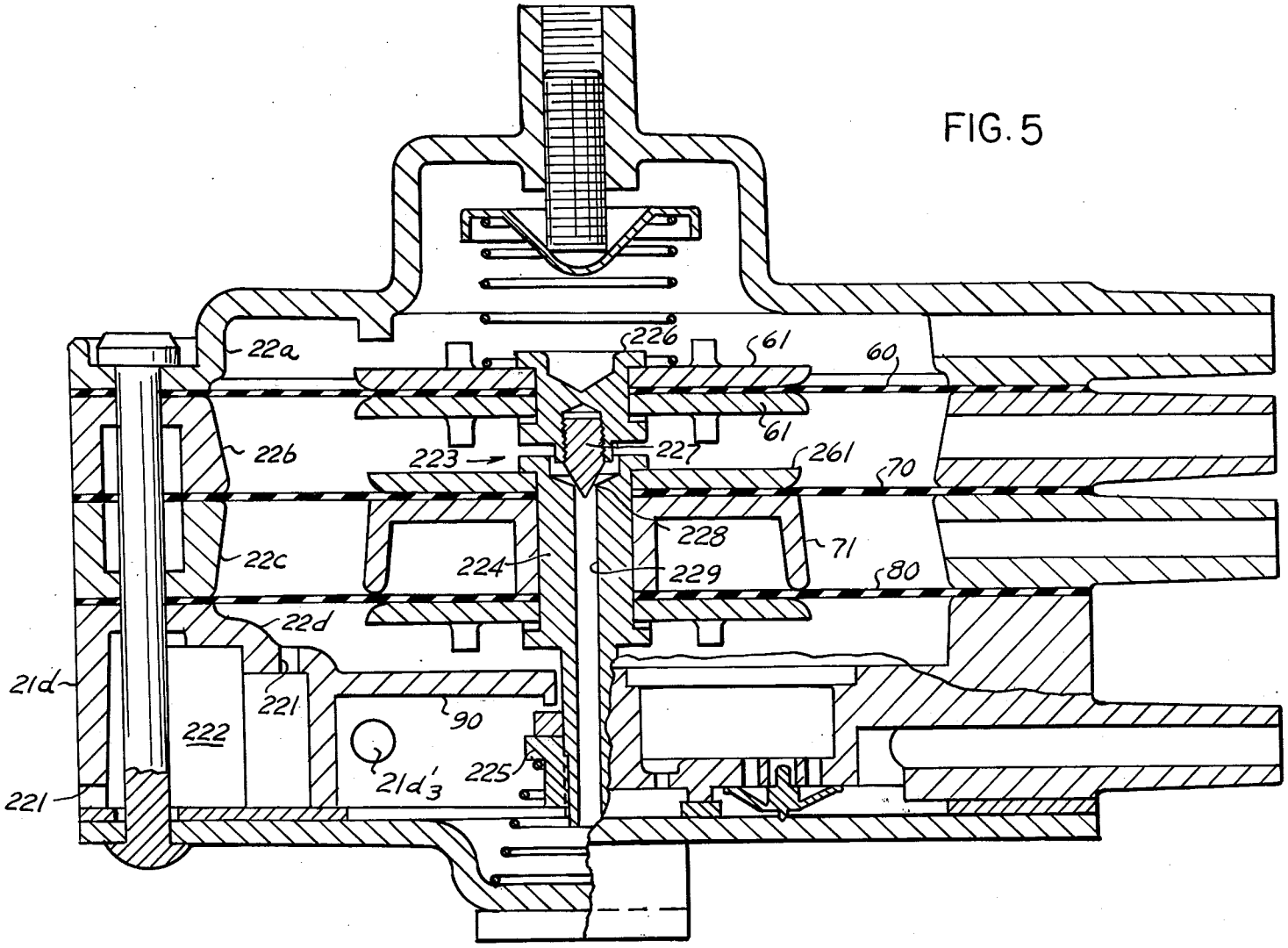
FIG. 5 is a cross-sectional view of the control valve assembly shown in FIG. 1 and illustrating an alternate embodiment of the invention which incorporates a limiting function which cuts off the recirculated exhaust gas when intake manifold vacuum is low and engine air flow is high.

Referring to FIG. 5 an alternate embodiment of the invention is shown incorporating a limiting function which terminates EGR flow when intake manifold pressure $P_m$ approaches atmospheric pressure $P_a$ and engine air flow is high. The portions of the control valve assembly 20 which are the same as those shown in FIG. 1 carry the same reference numerals in FIG. 5. Chamber cavity 22*d* is subject to a filtered source of atmospheric pressure $P_a$ communicated to chamber 22*d* through passages 221 and filter element 222. For purposes of clarity only that portion of passage 21*d*$_3$' that intersects with cavity 90 is shown. It is understood that as in FIG. 1, passage 21*d*$_3$' communicates with chamber 15 of the EGR valve.

Control valve member 223 which is an alternate embodiment is referred to as a receiving or summing means and is comprised again essentially of three main parts, a stem portion 224, an adjustment member 225 and a second stem portion 226 incorporating a valve body 227. Stem portion 224 is fixedly secured to diaphragms 70 and 80 through distribution members 61, 71 and 261. Stem portion 226 is secured to diaphragm 60 through distribution member 61 and at its lower extremity incorporates valve body 227. Adjustment member 225 is threadedly disposed on one end of stem 224. The opposite end or upper portion of stem 224 includes valve seat 228. Stem 224 also has a central passage 229 which permits any signal in housing chamber 22*b* to communicate with cavity 90 when valve body 227 is unseated from valve seat 228. It can readily be understood that when the force generated across diaphragm 60 acts in an upward direction, with a sufficient magnitude to overcome the spring force 130 valve body 227 will unseat from valve seat 228 and permit the signal present and chamber 22*b* $P_m$ to be communicated through passage 229 to cavity 90 and through passage 21*d*$_3$' to chamber 15 of EGR valve 10.

OPERATION

To simplify the understanding of the operation of the exhaust gas recirculation flow control system, the operation of the system immediately before the EGR flow control valve begins to open will first be considered. From this discussion it will be obvious to one skilled in the art that the amount of EGR recirculated to the intake manifold is a function of both engine air flow and intake manifold pressure. The function related to intake manifold pressure is obtained through controlling the relationship of the effective areas of the diaphragms. Therefore, once EGR beings to flow the overall effect of this function upon the control valve assembly can only be determined by looking at the net forces generated to open or close valve 27. It will be obvious to those skilled in the art from the discussion that follows as to how the above engine parameters affect the net force generated on the control valve assembly to thereby control the recirculation of exhaust gas into the intake manifold.

For discussion purposes, manifold vacuum, venturi vacuum, etc., will be regarded as pressures, recognizing that they are normally negative with respect ot atmospheric pressure.

The control valve assembly serves to regulate the pressure $P_{EGR}$ which controls the opening and closing of the EGR valve. The position of the valve 27 with respect to the valve seat 92 is determined by the summation of forces on valve stem 24. These forces consist of spring forces 130 and 140, biasing the valve stem, and forces exerted by the three diaphragms 60, 70 and 80 under the action of the differential pressures across said diaphragms. As indicated above, diaphragm 60 has an effective area equal to $A_6$, diaphragm 70 has an effective area equal to $A_7$ and diaphragm 80 has an effective area of $A_8$.

Carburetor venturi pressure $P_v$ is communicated from the carburetor through conduit passage 48 and housing passage 21*a'* to the top side of diaphragm 60 in chamber 22*a*. The pressure signal $P_v$ decreases as the engine air flow increases through the carburetor. The intake manifold pressure, $P_m$, is communicated through conduit passage 36 and housing passage 21*b'* to chamber 22*b* and to the underside of diaphragm 60 or top side of diaphragm 70. A filtered source of atmospheric pressure, $P_a$, is communicated through passage 21*d'* to chamber 22*d* or to the underside of diaphragm 80. Recirculated exhaust gas pressure, $P_e$, is communicated from exhaust gas passage 32 between exhaust gas valve seat 38 and restriction 35, to the top side of diaphragm 80 in chamber 22*c* through conduit passage 37 and housing passage 21*c'*. A pressure source, normally the spark port pressure, provides pressure signal $P_s$ to chamber 122 through housing passage 21*$d_2$'* and conduit passage 115. This pressure source $P_s$ is maintained at the lowest attainable pressure at spark port 43 by check valve 124 which permits air flow only towards the intake manifold.

In the control valve assembly, an orifice 111 separates pressure $P_s$ from chamber 80 and therefore $P_{EGR}$ is some function of $P_s$, said function being determined by the position of valve 27 relative to valve seat 92, or the net force on valve stem 24.

When valve 27 opens fully, $P_{EGR}$ becomes nearly equal to atmospheric pressure $P_a$. Since the cross-sectional area $_9$ of passage 91 is substantially greater than the cross-sectional area of orifice 111, atmospheric pressure, $P_a$, is communicated from chamber 22*d* through passage 91 and into cavity 90. When valve 27 is fully closed, only $P_s$ is communicated to cavity 90 and therefore, $P_{EGR}$ will equal $P_s$. As pressure signal $P_{EGR}$ decreases and approaches $P_s$, the force generated across diaphragm 13 of the EGR valve 10 increases sufficiently to overcome the biasing force $F_l$ due to the spring 17 and the EGR valve will begin to open permitting exhaust gas to be recirculated into the intake manifold. When $P_{EGR}$ equals $P_s$, the EGR valve will be fully open.

The functional relationship between recirculated exhaust gas flow and air flow through the engine can easily be seen by considering the effect of only air flow on the control valve assembly when the EGR valve is closed. Under this condition, $P_e$ is equal to $P_m$ and the net force generated on control valve member 23 is directly related to the venturi pressure $P_v$ in cavity 22*a* and the atmospheric pressure $P_a$ in cavity 22*d*. The pressure differential $P_a$ - $P_v$ increases with increasing air flow through the carburetor. The effective areas of diaphragms 60 and 80 are essentially equal $A_6 = A_8$ and all three diaphragms act directly on the valve stem. Diaphragm 70 not having a differential pressure across it will therefore not generate a force. Thus, an increase in air flow increases the differential $P_a$ - $P_v$ and causes an increase in the upward force on the valve stem 24, tending to close valve 27 and thereby start EGR flow by reducing the influence of $P_a$ on $P_{EGR}$.

When exhaust gas begins to flow in passage 32, a feedback signal tending to null the effect caused by the air flow through the carburetor is generated. The nulling effect is such that for a given air flow a certain EGR flow will be obtainable regardless of the variations in the EGR valve design parameters. This nulling or feedback effect is illustrated by considering the effect of exhaust gas flow when the EGR valve begins to open. As soon as the EGR valve opens and exhaust gases are permitted to flow in exhaust gas passage 32 past orifice 35, $P_3$, the pressure upstream of the metering orifice, no longer equals $P_m$, the pressure downstream of the metering orifice or intake manifold pressure. This results in a differential pressure $P_e - P_m$ across diaphragm 70. This differential pressure $P_e - P_m$ relates to EGR flow in the same way that $P_a - P_v$ relates to air flow. The essential difference, however, is that $P_3$ and $P_m$ act not only on diaphragm 70 but also on diaphragms 80 and 60 respectively. Since the effective area of diaphragm 80 is greater than the effective area of diaphragm 70, an increase in $P_e$ will result in a downward force on valve stem 23 thereby tending to move valve 27 from its valve seat 92 open and permit pressure $P_a$ from chamber 22*d* to be communicated to cavity 90 and through passage 21*$d_3$'* to the EGR valve. The pressure in chamber 15 of the EGR valve will then increase and approach atmospheric pressure which will cause the EGR valve to close. The intake manifold pressure, $P_m$, in cavity 22*b* has a similar influence across diaphragm 60 but in the opposite direction of the force generated across diaphragm 80. It can therefore be seen that an increase in EGR flow, which results in an increase in the pressure differential $P_e - P_m$, which in turn will increase the downward force on the control valve member 23 causing valve 27 to move away from valve seat 92 thereby permitting pressure signal $P_a$ to be communicated to chamber 90 resulting in $P_{EGR}$ becoming a greater function of $P_a$ rather than $P_s$ and thereby beginning to close the EGR valve by reducing the force generated across diaphragm 13 in the EGR valve. The above described exhaust gas flow sensing function is referred to as the closed loop control of the exhaust gas flow recirculation system.

An additional function of the restriction 35 in the exhaust gas passage 32 is to limit the maximum amount of exhaust gas recirculated to the intake manifold. When the EGR flow becomes limited by the effect of orifice 35 the pressure differential $P_e - P_m$ remains relatively constant and as a result further increases in air flow increases the closing force on the valve. Under these conditions the spark port pressure will continue to decrease and approach atmospheric pressure. Check valve 124 is designed to maintain $P_s$ at its former level rather than permit it to decrease and approach atmospheric pressure present at the spark port. The effect of check valve 124 maintaining $P_s$ at its former level results in the EGR valve maintaining its former position. Therefore, the combination of reservoir 122 and check valve 124 maintains an adequate pressure source regardless of the variations in engine air flow or engine manifold pressure when EGR flow is maximized and regardless of whether the reservoir is controlled by spark port pressure or by manifold pressure. The EGR valve is thereby enabled to be operative at very low pressure levels while still having the capability of delivering EGR flow at pressure levels nearly equal to atmospheric pressure.

The functional relationship between recirculated exhaust gas flow and intake manifold pressure is obtained by permitting the effective area of diaphragm 60 to be different than the effective area of diaphragm 80. This will become clear to one skilled in the art considering a condition where the effective areas of diaphragm 60 and diaphragm 80 have equal effective areas. Under this condition manifold pressure $P_m$ will have little effect on the EGR flow. Before EGR begins to flow $P_e$ equals $P_m$, and the force contribution of diaphragm 70 to the overall net force on valve stem 23 is zero. If the area of diaphragm 60 is greater than that of diaphragm 80, an increase in manifold pressure $P_m$ (equal to $P_e$) will contribute an upward force to the net force on valve steam 23 and assist in closing valve 27 causing EGR to start flowing at a lower air flow. As air flow increases, the effect is for EGR flow to remain higher at high values to intake manifold pressure $P_m$ (low vacuum) than at lower levels to intake manifold pressure.

It can therefore be easily seen that the net force operating on valve stem 23 can be independently controlled by selecting diaphragm 60 to have a larger effective area than diaphragm 80 and thereby cause intake manifold pressure in chamber **22*b* to independently affect the force required to move valve 27 relative to valve seat 92. This is effectively illustrated in FIG. 6.** Note that at six inches of manifold vacuum represented by curve D the exhaust gas recirculated to the intake manifold begins at a substantially lower air flow than that shown by curve E where the intake manifold vacuum is 14 inches of vacuum. Therefore, the percentage of EGR flow recirculated to the intake manifold is not only a function of air flow as described above, but also a function of intake manifold vacuum.

By modifying and changing the various design parameters shown herein and, for example, by using intake manifold pressure instead of spark port pressure as a source pressure in reservoir 122, different criteria for affecting cut in and cut off of EGR flow can be accomplished.

Figure 6:
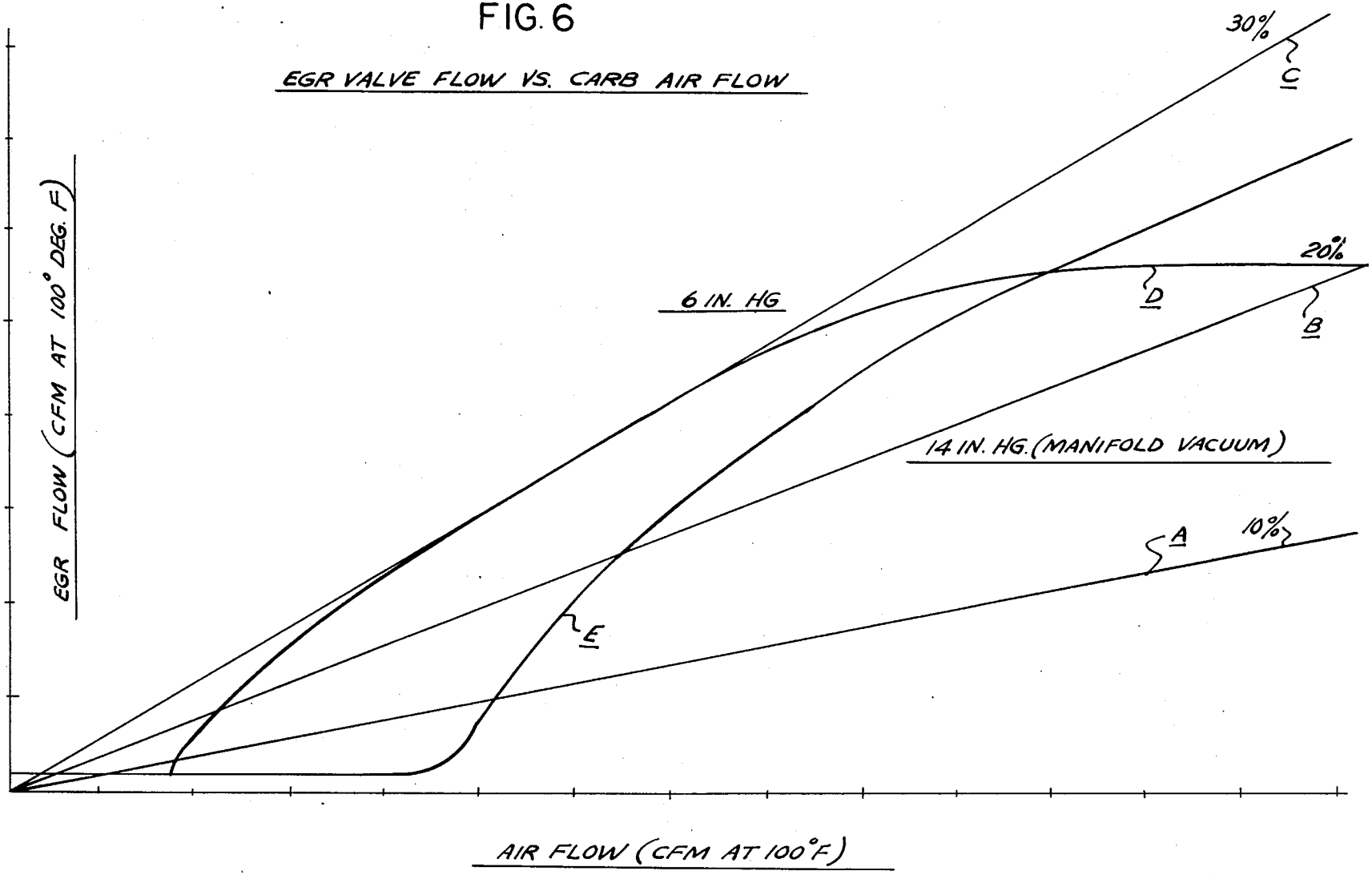
FIG. 6 graphically illustrates the test results of the invention as applied to an existing internal combustion engine.

The alternate embodiment of control valve 20 shown in FIG. 6 provides the feature of a complete cut off function when the intake manifold pressure approaches atmospheric pressure and engine air flow is high. This is desirable to permit full utilization of the power potential of the engine which is not normally associated with urban driving. Under these conditions normally the engine air flow is high and the manifold pressure is relatively close to atmospheric pressure. At high engine air flows the pressure signal $P_v$ in chamber **22*a* will be substantially lower than the pressure signal $P_m$ in chamber 22*b*. The net effect of the summation of these two pressure signals will be to cause an upward force on diaphragm 60. As diaphragm 60 deflects upwards valve 227 is caused to unseat from valve seat 228 thereby uncovering a passage through stem 224 which allows pressure signal $P_m$ to be communicated to chamber 90. The effect of communicating pressure signal $P_m$, which is approaching atmospheric pressure, to chamber 90 will cause pressure signal $P_{EGR}$ to become a greater function of $P_m$. Pressure signal $P_{EGR}$ is communicated to chamber 15 of EGR valve 10 and as $P_{EGR}$ approaches $P_m$ the balance of forces across diaphragm 13 of EGR valve 10 will equalize each other thereby permitting spring 17 to bias valve stem 12 and valve body 18 towards valve seat 38. The effect of this cut off function is to stop the recirculation of the exhaust gases through exhaust gas passage 32 to the intake manifold when $P_m$ approaches $P_a$ and engine air flow is high. Therefore, under these conditions full utilization of the engine's power potential is available and in effect provide more economical operational characteristics. As the air flow declines, the pressure differential $P_v - P_m$ across diaphragm 60 will be insufficient to keep valve 227 unseated, and therefore valve 227 will seat on valve seat 228** and permit the net forces across the control valve assembly to again be a function of the engine's air flow and intake manifold pressure as earlier discussed.

As was described above, the temperature responsive element 50, as shown in FIG. 4, can be caused to react making the control valve responsive to low and/or high ambient or engine compartment temperature in order to inhibit EGR flow when either of these conditions exist. That is, as the engine compartment temperature decreases a predetermined temperature is eventually reached which will cause the bimetal strip to bend downwardly away from valve seat 96, thereby opening passage 95 to cavity 90 and permitting pressure signal $P_a$ to communicate with the pressure signal $P_{EGR}$ in cavity 90. This results in $P_{EGR}$ being a greater function of $P_a$ than $P_s$ and since $P_{EGR}$ is communicated through passage **21*d*$_3$' and passage 16 to chamber 15 of the EGR valve, the EGR valve will begin to close. Temperature element 50** will maintain an open position until ambient temperatures have reached a predetermined level thereby inhibiting EGR flow below this predetermined level.

Whenever valve 27 as well as valve 97 is not in contact with its respective valve seat, there is a continuous flow of fresh air through passage **21*b*', 91 or 95 into cavity 90 and into cavity 122. If this fresh air was permitted to continue to travel through passage 21*d*$_2$' and into the spark port area of the carburetor these large amounts of fresh air would create air fuel ratio errors and adversely affect the operation of the engine. Orifice 111 is designed to serve the function of preventing large amounts of fresh air to flow into the carburetor spark port area. Check valve 124 as shown in FIG. 4, serves the purpose of preventing the flow of air from the spark port passage or alternately from the intake manifold should the intake manifold be used as a source pressure, to chamber 122.** As earlier discussed, it also serves the function of maintaining $P_s$ at a level different than the spark port pressure.

Referring to FIG. 7, actual test results are graphically illustrated. Lines A, B and C represents plots of an EGR system designed for EGR flows of exactly 10, 20 and 30 percent of the engine air flow respectively. Line D is a plot of the disclosed system wherein intake manifold vacuum is 6 inches of mercury. Line E is a plot of the exhaust gas recirculated to the intake manifold at a vacuum level of 14 inches of mercury. As discussed above, the curves illustrated indicate the objects of the invention, since EGR is inhibited at low engine air flows and also EGR flow is illustrated as a function of not only engine air flow, but also intake manifold pressure.

Although only one preferred embodiment and an alternate embodiment showing the cut off function has been illustrated in the accompanying figures and description of the foregoing specification, it is especially understood that various changes may be made to the embodiment shown and described without departing from the spirit and scope of the invention as will now be apparent to those skilled in the art. Also, it will be apparent that changes may be made to the invention as set forth in the appended claims and in some instances certain features of the invention may be used to advantage without corresponding use of other features. For example, it was pointed out that the control of the control valve member 23 can be easily modified by changing some of the design parameters, (i.e. size of certain of the pressure sensitive elements contained in the housing 21). Also, on a qualitative basis, control valve 23 can control the EGR flow directly. However, since the venturi pressure signals are relatively low and since the EGR valve must have a significant cross sectional area, this approach would require very large diaphragms and would thus be impractical. Accordingly, it is intended that the illustrative and descriptive materials herein be used to illustrate the principles of the invention and not to limit the scope thereof.

I claim:

1. In a control valve, a housing having an inlet, and an outlet, said housing defining a chamber therewithin, pressure responsive means dividing said chamber into a first section communicated to a first independent control pressure parameter, a second section communicated to a predetermined pressure level, valve means shiftable from a first condition communicating said second section with said outlet to a second condition, said valve means in said second condition terminating communication between said second section and said outlet but permitting communication between said inlet and said outlet, first means responsive to the pressure differential between said first and second sections to actuate said valve means, and second means responsive to a second independent control pressure for opposing the force generated by said pressure differential created between the first and second sections, said second independent control pressure being affected by the pressure level at said outlet to provide a feedback control on the operation of said valve elements.

2. The invention of claim 1, wherein said valve elements include a valve stem for operating said valve elements and said first means include a pair of diaphragms attached to the wall of said housing and to said stem for actuating the latter, and for dividing said chamber into said first and second sections.

3. The invention of claim 2, wherein one of said diaphragms cooperates with the wall of said housing to define said first section and the other diaphragm cooperates with the wall of said housing to define said second section.

4. The invention of claim 3, wherein said diaphragms cooperate with one another to define a compartment therebetween, said second independent control pressures being communicated to said compartment.

5. The invention of claim 4, wherein a third diaphragm divides said compartment into a first division between the first diaphragm and the third diaphragm and a second division between the second diaphragm and the third diaphragm, said second independent control pressures including a first pressure level communicated to the first division of said one compartment and a second pressure level communicated to said second division.

6. The invention of claim 4, wherein said control valve includes temperature responsive valve means controlling communication between said outlet and said second section.

7. The invention of claim 6, wherein said control valve includes a reservoir communicated to said inlet, and a flow restricting orifice between said reservoir and said outlet.

8. The invention of claim 1, wherein said control valve includes temperature responsive valve means controlling communication between said outlet and said second section.

9. The invention of claim 1, wherein said control valve includes a reservoir communicated to said inlet, and a flow restricting orifice between said reservoir and said outlet.

10. The invention of claim 9, wherein said control valve includes a check valve controlling communication between said inlet and said reservoir.

* * * * *